US006672408B2

(12) United States Patent
Frantz

(10) Patent No.: US 6,672,408 B2
(45) Date of Patent: Jan. 6, 2004

(54) SYSTEM AND APPARATUS FOR EXCAVATING CONTAMINATED PILINGS

(76) Inventor: Anthony F. Frantz, 1037 Wild Coyote Rd., Freeland, WA (US) 98249

( * ) Notice: Subject to any disclaimer, the term of this patent is extended or adjusted under 35 U.S.C. 154(b) by 77 days.

(21) Appl. No.: 10/007,138

(22) Filed: Dec. 3, 2001

(65) Prior Publication Data

US 2003/0102165 A1 Jun. 5, 2003

(51) Int. Cl.[7] ..... E21B 7/18; E02D 5/30
(52) U.S. Cl. ..... 175/67; 175/69; 405/240
(58) Field of Search ..... 175/67, 69, 113, 175/135, 162; 405/240, 228, 227, 257

(56) References Cited

U.S. PATENT DOCUMENTS

| | | | | |
|---|---|---|---|---|
| 1,644,560 A | | 10/1927 | Bignell | |
| 3,020,965 A | | 2/1962 | Keller, Jr. | 175/422 |
| 3,213,629 A | | 10/1965 | Manning | 61/53.52 |
| 3,379,265 A | | 4/1968 | Geiger | 175/215 |
| 3,842,917 A | | 10/1974 | Wisotsky | 173/90 |
| RE28,945 E | | 8/1976 | Miscovich et al. | 299/17 |
| 4,045,966 A | * | 9/1977 | Rusche | 405/240 |
| 4,319,784 A | * | 3/1982 | Claringbull | 299/64 |
| 4,372,707 A | | 2/1983 | Ostgaard | 405/224 |
| 4,512,683 A | | 4/1985 | Cosenza | 405/216 |
| 4,644,715 A | | 2/1987 | Burell et al. | 52/170 |
| 4,900,198 A | * | 2/1990 | Hoaki | 405/303 |
| 4,936,031 A | * | 6/1990 | Briggs et al. | 37/347 |
| 5,002,432 A | * | 3/1991 | Dysarz | 405/195.1 |
| 5,226,927 A | | 7/1993 | Rundstrom | 48/76 |
| 5,259,702 A | | 11/1993 | Simpson | 405/233 |
| 5,360,292 A | * | 11/1994 | Allen et al. | 405/249 |

* cited by examiner

*Primary Examiner*—Frank Tsay
(74) *Attorney, Agent, or Firm*—Seed IP Law Group PLLC

(57) ABSTRACT

A system and method for removing contaminated pilings is provided, the system including a casing to enclose the piling and a pressurized air system for excavating soil and contaminated materials from around the piling and material from the piling itself, capturing the excavated soil and contaminated material as it rises within the piling by action of the pressurized air, and a closure mechanism at the bottom of the casing for enclosing and removing the piling without spreading contamination to the surrounding environment. Clean fill material, such as sand, can be injected through the air nozzles or optional sand ports on the casing to fill the void left from the removed piling.

27 Claims, 12 Drawing Sheets

SYSTEM AND APPARATUS FOR EXCAVATING CONTAMINATED PILINGS

BACKGROUND OF THE INVENTION

1. Field of the Invention

The disclosed embodiments of the invention pertain to the removal of contaminated objects from soil, and, more particularly, to a system and method for excavating contaminated soil surrounding a piling, removing the piling and the contaminated soil, and filling the resulting hole with uncontaminated material.

2. Description of the Related Art

Pilings and similar support structures, such as fence posts, telephone poles, and light poles, are frequently treated with a preservative to resist corrosion and decay when mounted in the soil. In the past, creosote has been one preservative used to protect the wood. It has been discovered that creosote and other preservatives can be damaging to the environment and harmful to nearby life.

More particularly, creosote can seep into the soil surrounding the posts and pilings and pollute the soil, causing damage to plants growing nearby and endangering animal and human life as well as aquatic life. For example, barnacles, muscles, and similar aquatic life can attach themselves to creosote-treated pilings, becoming themselves contaminated. Marine life feeding on this contaminated material become contaminated and will in turn spread the contamination. Hence, there is a need to replace aging posts and pilings with environmentally safe substitutes.

Removing old posts and pilings, however, presents a number of challenges, not the least of which is causing further environmental damage in the removal process, and increased danger to nearby aquatic and animal life. For example, disturbing the contaminated soil and material attached to a piling while attempting to remove the piling will spread the contamination beyond the immediate area. Moreover, older pilings that have rotted tend to break apart when pulled upward, further spreading the contamination and making it more difficult to remove the remaining stub.

A number of devices have been proposed for removing pilings and the like. However, none of these address or solve the problem of containing and removing contaminants along with the piling. For example, U.S. Pat. No. 3,379,265 directed to a pile extractor and setter discloses lowering a casing over a piling and injecting liquid, such as water, or a gas, such as air, through nozzles on the casing to assist in driving the casing into the soil so that teeth on the casing will dig into the earth or sea bottom. In this device, excavated mud is expelled through mud slots in the casing into the surrounding water, which would further spread contaminants associated with the piling and the surrounding soil.

As another example, U.S. Pat. No. Re. 28,945 discloses an apparatus for excavating a tailing pond where high pressure liquid is jetted from inside a caisson to the soil on the outside of the caisson to create a pulping zone surrounding the caisson. The slurry formed in the pulping zone flows through portals in the bottom of the caisson into a slurry sump where it is pumped out to excavate the soil. Here, the outwardly-oriented water jets create a cloud of slurry outside the caisson that spreads throughout the water, extending the zone of contamination far beyond the immediate area.

Yet another example is an apparatus for removing piles disclosed in U.S. Pat. No. 1,644,560, wherein a plurality of pipes are lowered around the outside of a piling and high pressure water is forced out the bottom of the pipes to excavate the soil around the piling. In this device, the jetted water and loosened soil are not contained, resulting in a spreading of any contamination in the soil.

In a related device disclosed in U.S. Pat. No. 4,644,715, a soil-excavating sleeve having teeth on the bottom, interior doors, and flaps on the sides of the sleep, is rotated into the ground around a utility pole for half its length and left in place. The soil is excavated by the action of the doors or flaps forcing the soil out of the cylinder. The excavated annulus of soil is then filled with hardenable material and the sleeve is left in place as a re-enforcement to the utility pole. Here, the pole and the sleeve are left in the ground where the contamination can continue to spread, and not all of the contaminated soil is removed.

Hence, there is a need for a device that can excavate the soil surrounding a contaminated post or piling and remove the soil and the post or piling without endangering the environment and nearby life.

BRIEF SUMMARY OF THE INVENTION

The present invention is directed to a system and apparatus for excavating a contaminated object, such as a post or piling. In accordance with one embodiment of the invention, an excavation device is provided for removing an object from the soil, the device having a casing sized to be slidably received over the object and an excavation system associated with the casing for removing soil from around the object, the system using pressurized air to force soil to rise inside the casing and to remove the rising soil from the inside of the casing. Ideally, a mixture of pressurized air and liquid is used in environments where the soil is not under water.

In accordance with another aspect of the foregoing embodiment, the excavation system includes a plurality of nozzles associated with the casing and is configured to direct a stream of pressurized fluid, ideally comprising high-pressure air, towards the object and the soil to remove material from the object and excavate the soil; and a device for removing the excavated soil from within the casing. The removing device can comprise a suction hose or a filter for capturing the removed material and excavated soil.

In accordance with a further aspect of the foregoing embodiment, a closure mechanism is provided at one end of the casing used under water to enclose the object within the casing as the object is removed.

In accordance with still yet another aspect of the foregoing embodiment, ballast is provided to be attached to the casing for giving additional weight to the casing and to be used in replacing the removed soil and the void left by the removed object.

In accordance with another embodiment of the invention, a system is provided for removing a post from soil that includes a casing sized to be slidably received over the piling; and an excavating system for excavating soil from around the piling using pressurized air to force soil to rise inside the casing and to remove the soil from inside the casing; a device for forcing the casing into the soil; and a device for pulling the post from the soil.

In accordance with another embodiment of the invention, a system is provided for removing a piling from soil under water, the system including a casing having an interior sized to be slidably received over the piling; a plurality of air nozzles mounted near a first end of the casing and oriented to direct pressurized air at least towards the soil and also towards the piling to loosen soil from around the piling and to remove material from the piling, and to force the soil and removed material to rise to the surface of the water; and a device for capturing and removing the soil and material from the water in the interior of the casing.

In accordance with another embodiment of the invention, a method is provided for removing a post from soil, the method including placing a casing around the post; driving a casing into the soil; excavating soil from around the post using pressurized air to force the soil to rise inside the casing and removing the soil from inside the casing; and removing the post.

In accordance with still yet another embodiment of the invention, a method is provided for removing a piling from soil under water, the method including placing a casing around the piling; driving the casing into the soil; directing at least pressurized air through nozzles on the casing to the soil around the piling to loosen the soil and force the soil to rise upward inside the interior of the casing; removing the rising soil from the interior of the casing; and removing the post. Ideally, the air nozzles are also directed to the piling to remove contaminated debris from the piling, and the debris is forced to rise upward inside the casing.

In accordance with another aspect of the foregoing embodiment, the method further includes enclosing the bottom of the casing when the piling is removed to ensure all of the piling materials are removed from the water. Ideally, a fill material is injected in the remaining void to replace the removed soil and the piling.

As will be readily appreciated from the foregoing, the advantages of the present invention are that it completely contains the contaminated material as it is being excavated from around the piling and from off of the piling, including the soil, barnacles, and the like. This material is then forced to rise upward within the casing by the rising air from the pressurized nozzles. Because the casing completely surrounds the piling, and the pressurized air is injected within the casing and directed at the soil and the piling, the removed material and the excavated soil remain within the casing instead of spreading the contamination outside the immediate area. The optional doors on the bottom of the casing enclose the pole or piling as it is being lifted to ensure that all of the debris and other material associated with the contaminated object are removed from the water without spreading the contamination. The air nozzles can also be used to inject a fill material into the area where the object was removed to replace the excavated soil. Optional ballast to give the casing weight can sand that is later used to replace the soil and fill the void left by the removed object. It can be appreciated that the present invention can be modified for use in land operations where a mixture of air and water are injected inside the casing to excavate the soil surrounding the object.

BRIEF DESCRIPTION OF THE SEVERAL VIEWS OF THE DRAWING(S)

The foregoing and other features and advantages of the present invention will be more readily appreciated as the same become better understood from the following detailed description when taken in conjunction with the accompanying drawings, wherein.

DETAILED DESCRIPTION OF THE INVENTION

Figure 1:
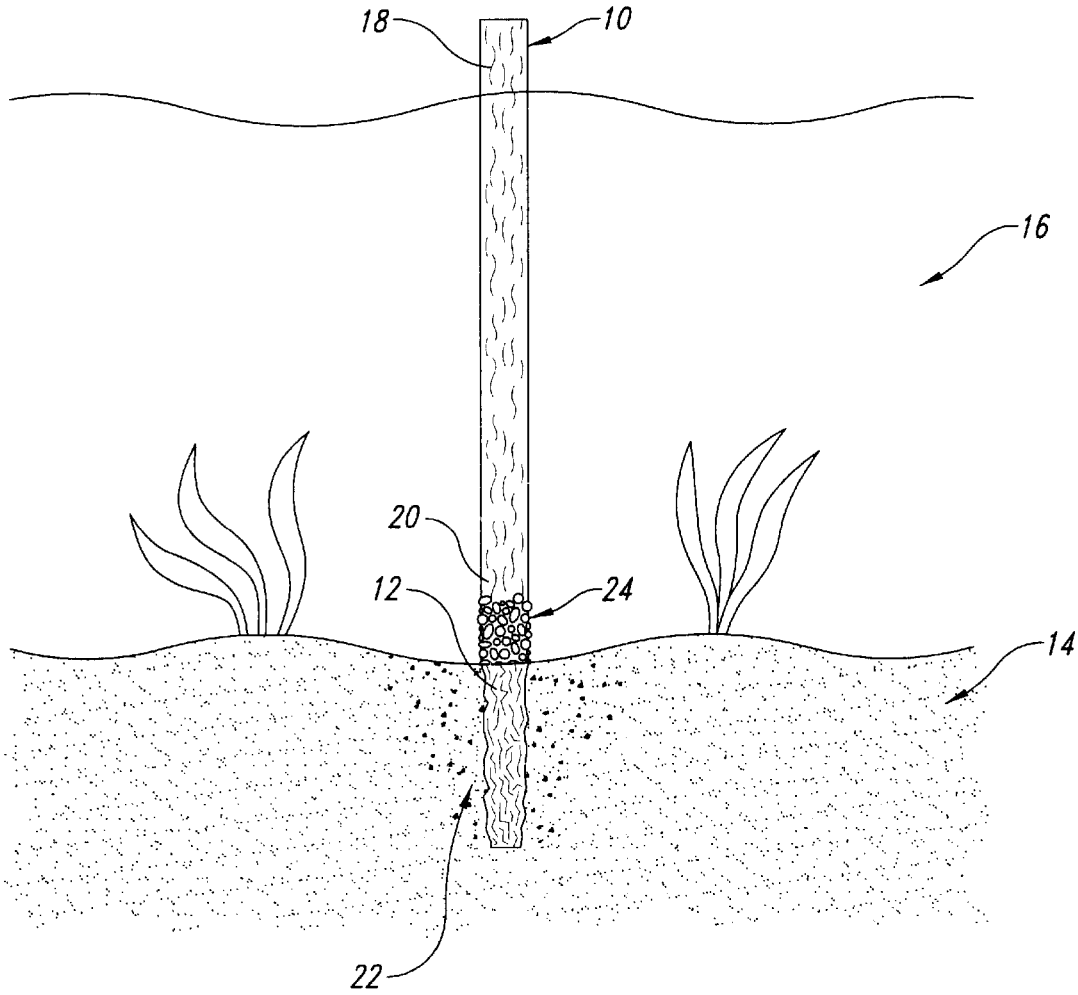
FIG. 1 is a side view of a contaminated piling in the water.

Referring initially to FIG. 1, shown therein is a piling 10 having a bottom end 12 anchored in the soil 14 beneath a body of water 16, above which the top end 18 of the piling 10 projects. As can be seen therein, the bottom 12 of the piling has deteriorated and released contaminants (shown as stippling 22) into the soil. Material 24 attached to the piling below the water level, representing barnacles, muscles, and the like, have attached themselves to the piling surface 20 above the level of the soil 14. Although the embodiments described herein are used to extract a piling, it is to be understood that the invention may be used in the excavation of other objects, such as posts, poles, and the like.

Figure 2:
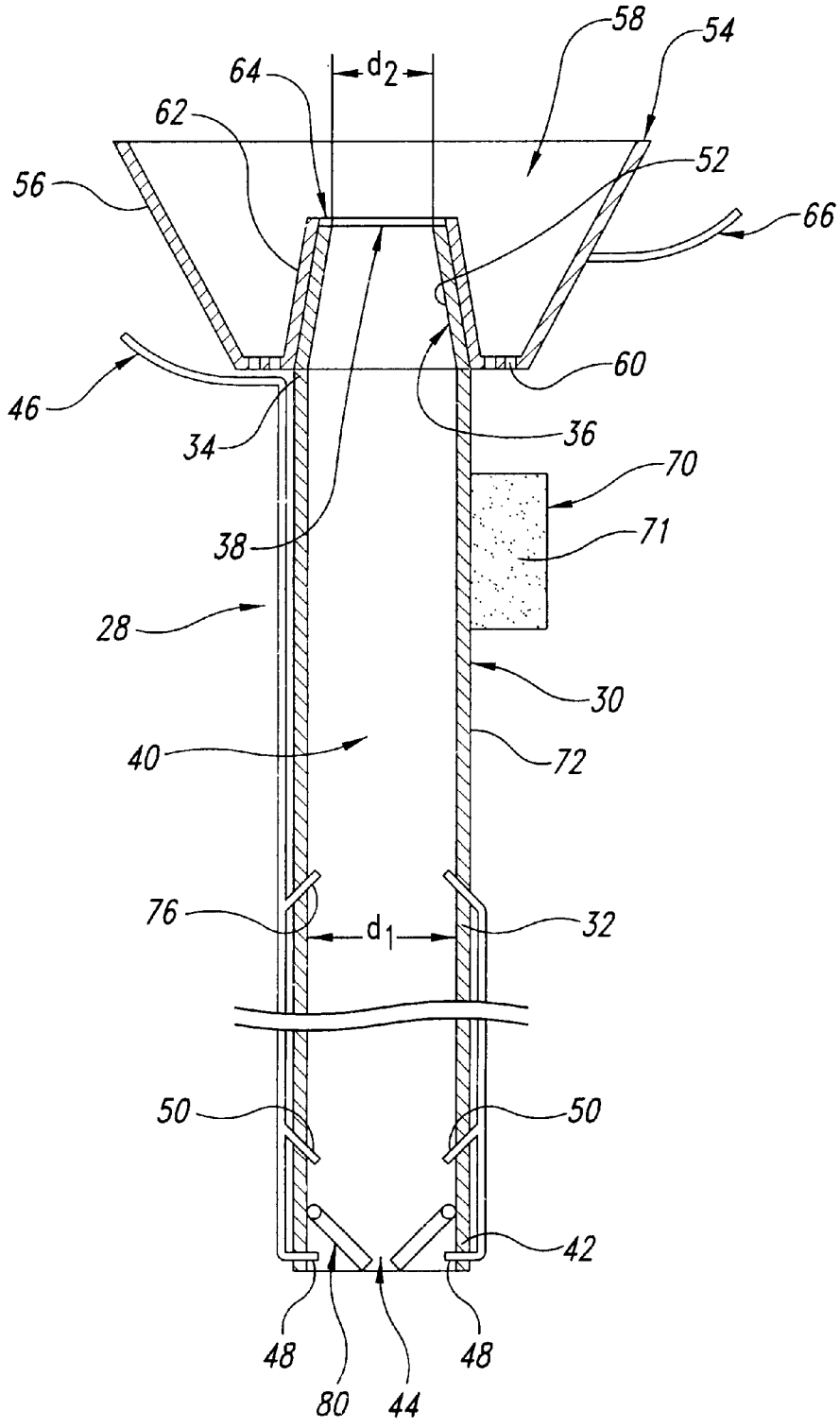
FIG. 2 is a cross-sectional side view of an excavation device formed in accordance with the present invention.

Turning next to FIG. 2, shown therein is an extraction device 28 formed of an extractor casing 30 having sidewalls 32 sized to define an internal diameter $d_1$, which ideally is sized to be 8 to 16 inches larger than the diameter of a piling to be removed (not shown in FIG. 2). In a preferred embodiment, the diameter $d_1$ is 12 inches larger than the piling, thus providing a 6-inch clearance on all sides of the piling. The cross-sectional configuration of the casing 30 can be shaped to accommodate the cross-sectional configuration of the piling, i.e., square, round, or other shape. At the top 34 of the casing 30 is a truncated cone-shaped funnel 36 having an open top 38 that defines a smaller diameter $d_2$, which is smaller than the internal $d_1$ of the main body of the casing 30. The casing 30 thus has a longitudinal internal bore defining an interior 40 that opens at one end through the opening 38 and that opens at the other end 42 through a second opening 44. The funnel 36 is attached at the top of the casing 30 over the second opening 44.

A supply line 46 is shown associated with the exterior of the casing 30 and having at a terminal end a plurality of nozzles 48 mounted at the lower end 42 of the casing 30. The nozzles 48 are oriented to point towards the interior 40 of the casing 30. Ideally, at least a portion of the nozzles 48 will point downward towards the soil (not shown in FIG. 2) encompassed by the lower end 42 of the casing 30. The supply line 46 is configured for attachment to a source of pressurized fluid, such as pressurized air, or pressurized water, or a mixture of pressurized air and water. A second set of nozzles 50 are positioned above the first set of nozzles 48 and are angled to point downward towards the second opening 44. Additional sets of nozzles may be positioned around the interior 40 of the casing 30 as desired. The orientation of the nozzles 48, 50 is selected to direct the pressurized fluid to either the soil surrounding the piling, to the piling itself, or to both the piling and the soil. When directed to the soil, the nozzles direct the pressurized fluid, preferably pressurized air, to loosen the soil, forcing the soil to rise upward within the interior 40 of the casing 30 by action of the rising air bubbles from the pressurized air. The nozzles 48, 50 can also be oriented to direct the pressurized air to the piling itself to remove the material clinging thereto, which is also forced to rise with the rising air bubbles from the pressurized air to the surface of the water.

In another embodiment, a third set of nozzles 76 are provided midway up the interior sides 32 of the casing 30 and are pointed upward to assist in urging the removed material and excavated soil upward to the top of the casing 30. It is to be understood that at least one of these nozzles 76 may be used as desired and positioned throughout the interior 40 of the casing 30 as desired.

The funnel-shaped top 36 may be integrally formed with the casing 30 or attached to the top of the casing 30 with suitable fasteners or latches as are conventionally known and commercially available. The funnel-shaped top 36 is designed to force the rising air bubbles and entrained soil and material through the opening 38 at the top thereof and out of the casing 30. The emerging air bubbles and soil and material exit the funnel-shaped top 36 and spill down the sides 52 thereof. In one embodiment, a trap 54 is provided at the top of the casing 30 to surround the funnel-shaped top 36 as shown in FIG. 2. The trap 54 has an outer wall 56 defining an opening 58 at the top thereof. The outer wall terminates at a bottom wall 60 that circumscribes the top of the casing 30. An angled interior wall 62 joins the bottom wall 60 and is formed at an angle that matches the angle of the funnel-shaped top 36. The angled interior wall 62 circumscribes an opening 64 that matches in size and shape the opening 38 defined by the funnel-shaped top 36.

The trap 54 is designed to capture the material and soil that rises through the opening 38 in the casing top 30 and spills over the angled interior walls 62 positioned on top of the sides 52 of the funnel-shaped top 36. In one embodiment, a suction hose 66 is attached to the trap 54 to suction out the contaminated material and debris. In another embodiment, the trap 54 can be detached and lifted from the top of the casing 30 and turned over to empty the contaminated material and soil therefrom.

Also shown in FIG. 2 is an optional ballast container 70 attached to the exterior 72 of the casing 30 to provide extra weight for the casing as it is being urged down into the soil. The ballast container 70 ideally is filled with sand 71 or other uncontaminated material 74 that can later be used to fill in the void created by the removed piling and to replace the excavated contaminated soil, as described more fully herein below.

In a further embodiment, a closure mechanism 78 is provided at the bottom 42 of the casing 30 to enclose the casing 30 and the piling during removal of the piling. Ideally, the closure mechanism 78 consists of one or more doors 80 that are hydraulically or electrically actuated when the bottom of the piling is pulled into the interior 40 of the casing 30 or when the casing 30 has its bottom 42 driven below the bottom of the piling. In another configuration, the doors 80 may be spring loaded to automatically close as it passes by the bottom of the piling. Alternatively, the doors 80 may be actuated when a sensor detects the passage of the bottom of the piling. Preferably the doors 80 seal the bottom 42 of the casing 30 to prevent the escape of any contaminated soil or removed material or piling debris. However, the doors 80 may be provided with drain holes to allow the drainage of water as the casing 30 and piling are lifted out of the water to reduce the amount of weight that must be lifted.

Ideally the casing 30 is constructed of strong material, such as ¾ inch to 1 inch thick heavy-duty steel, preferably sharpened at the bottom adjacent the lower end 42. To facilitate installation and removal as well as storage and transportation of the casing 30, the casing 30 may be constructed in two or more sections that are bolted together. The sections may be vertically attached together to accommodate the length of the piling, or they may be longitudinal sections that are attached together at their sides in a conventional manner.

Figure 3:
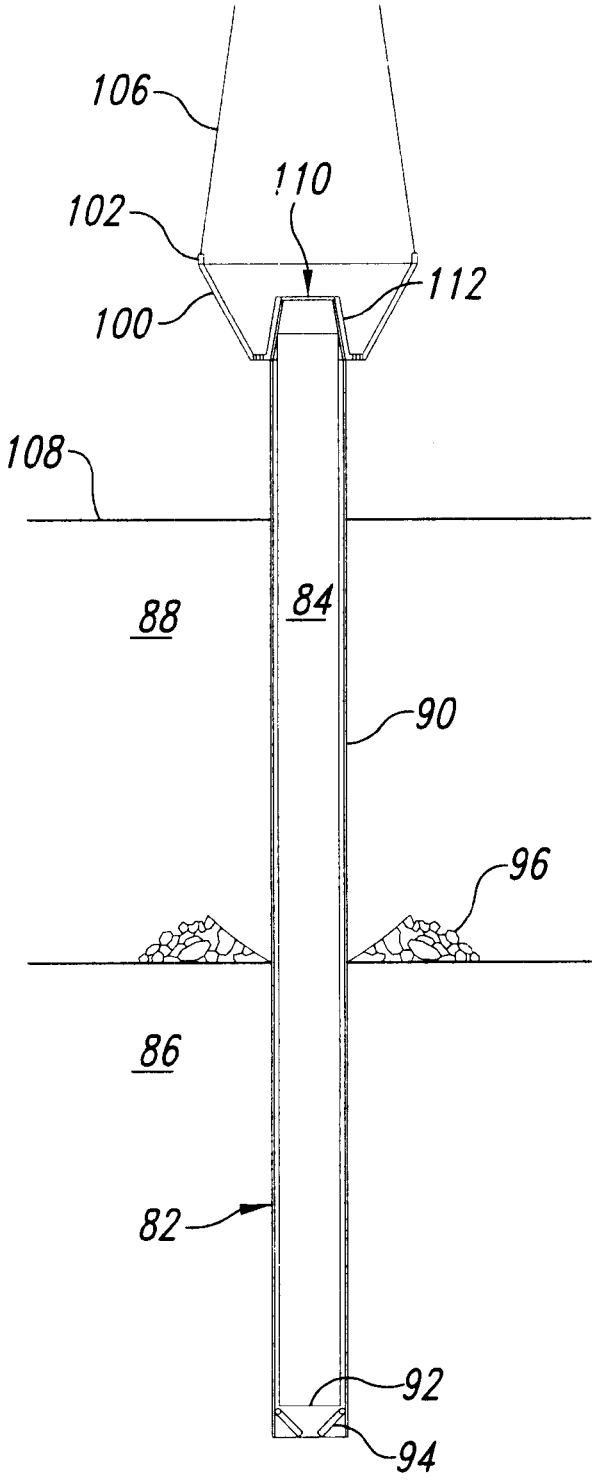
FIG. 3 is a side view of one embodiment of the excavation device formed in accordance with the present invention installed over an existing piling.

Turning next to FIG. 3, shown therein is a device 82 for removing a piling 84 from the soil 86 below a body of water 88. The device 82 includes a casing 90 that has been forced down below the bottom 92 of the piling 84 such that the doors 94 have closed therebelow. The dead marine life 96 and excavated soil 86 have been removed from the casing 90 through the trap 100 at the top thereof. The trap 100 includes pickup rings 102 for attachment to a crane or other lifting device 104 (shown in FIG. 4) by chains 106 or cables. Although not shown herein, the trap 100 can contain a walkway on the interior for workmen to stand on while fastening the trap 100 to the casing 90 and the chains 106 to the pickup rings 102, and while attaching a choker cable to the piling 84. The trap 100 is constructed of reinforced steel to enable the use of a vibratory hammer 142 (shown in FIG. 4) to drive the casing 90 into the soil 86.

In this embodiment, the piling 84 has been cut so that it projects above the surface 108 of the water 88 to enable attachment of a choker cable (shown as 202 in FIG. 6D) that extends up through the opening 110 in the funnel-shaped top 112 on the casing 90.

Figure 4:
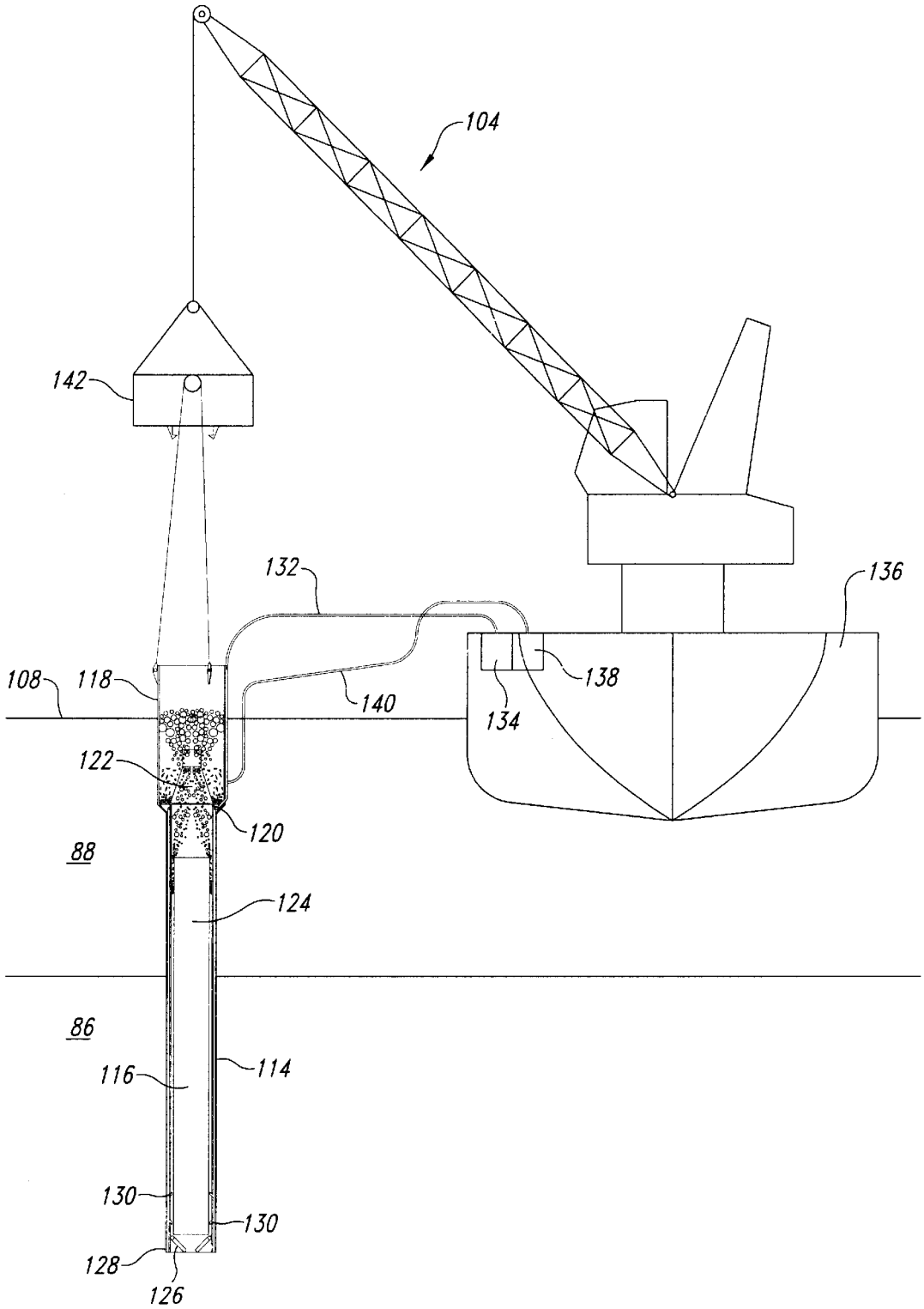
FIG. 4 is a side view of an extractor casing being driven into the soil and the excavation thereof from around the bottom of the piling.

FIG. 4 shows another embodiment of the invention wherein a casing 114 is received over a piling 116 that is below the surface 108 of the water 88. A sediment trap 118 is formed at the top 120 of the casing 114 to capture sediment exiting from the funnel-shaped top 122 on the casing 114. Because the piling 116 has its top 124 below the water surface 108, it is not feasible to attach a choker chain to the piling to remove it from the soil 86. Hence, the trapdoors 126 at the bottom of the casing 128 are used to lift the piling 116 out of the water 88. The plurality of nozzles 130 mounted on the casing 114 are supplied by an air line 132, as previously described, that is connected to a source of pressurized air 134 that in this embodiment is attached to a floating support, such as a barge 136 or other vessel.

Because this embodiment does not have a removable trap, the sediment trap 118 is emptied by a surface suction unit 138 via a hose 140 attached to the sediment trap 118 below the surface 108 of the water 88.

As shown in FIG. 4, a vibratory hammer 142 is used to drive the casing 114 into the soil 86. The hammer 142 is suspended from the crane 104 that in turn is supported by the barge 136 or vessel. Vegetable oil or other environmentally safe non-compressible fluid should be used for the hydraulic equipment associated with the hammer 142.

Figure 5:
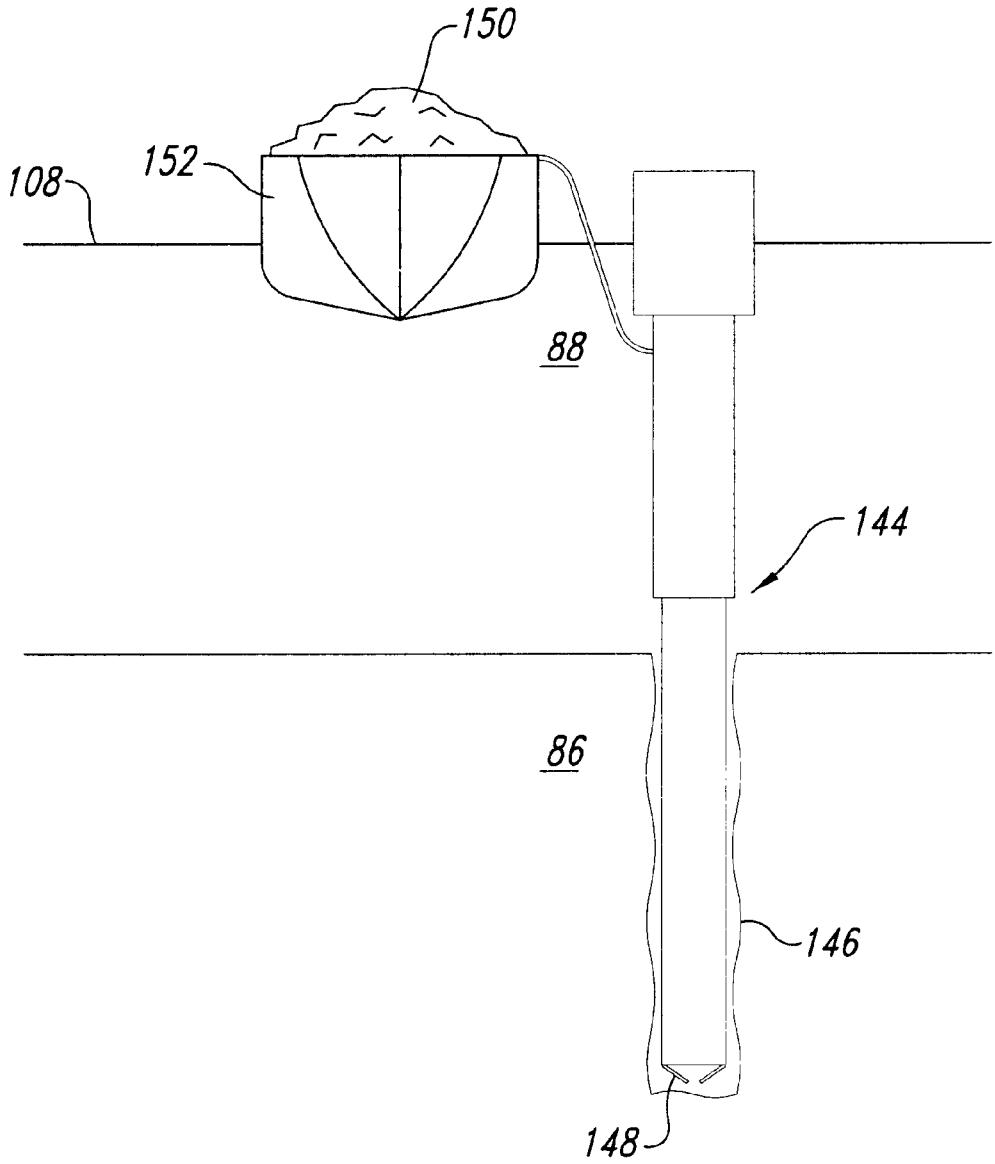
FIG. 5 is a side view of another embodiment of the invention having a telescoping casing for filing holes with uncontaminated material.

Turning to FIG. 5, shown therein is yet another embodiment of the invention wherein a telescopic casing 144 is used to decontaminate a hole 146 left by a previously-removed piling. Here, the telescopic casing 144 projects down into the hole 146 and the nozzles 148 are used to inject sand 150 supported on a barge 152 into the hole 146. Flexible hoses are used on the telescopic casing 144 to accommodate the extension and retraction of the casing 144.

It is to be understood that the disclosed embodiments of the invention can be adapted for land use to remove contaminates around the base of power poles, telephone poles, and the like, or from pilings projecting from wetland, marshes, and generally in sensitive areas where water is not a factor. In this case, high pressure air with water added as needed is provided to the nozzles, which causes the water to rise within the casing along with the entrained soil and debris, which is then suctioned off from the top.

FIGS. 6A–6D illustrate one method of extracting a contaminated piling 154 from soil 156 under water 158 using the device 160 substantially as shown and described above with respect to FIG. 2. Initially, the diameter and height of the exposed portion 162 of the piling 154 above the surface 164 of the water 158 is measured. The remaining length of the piling 154 above and below the surface of the water can either be estimated or it can be measured by equipment that is readily commercially available, which will not be described herein.

Figure 6A:
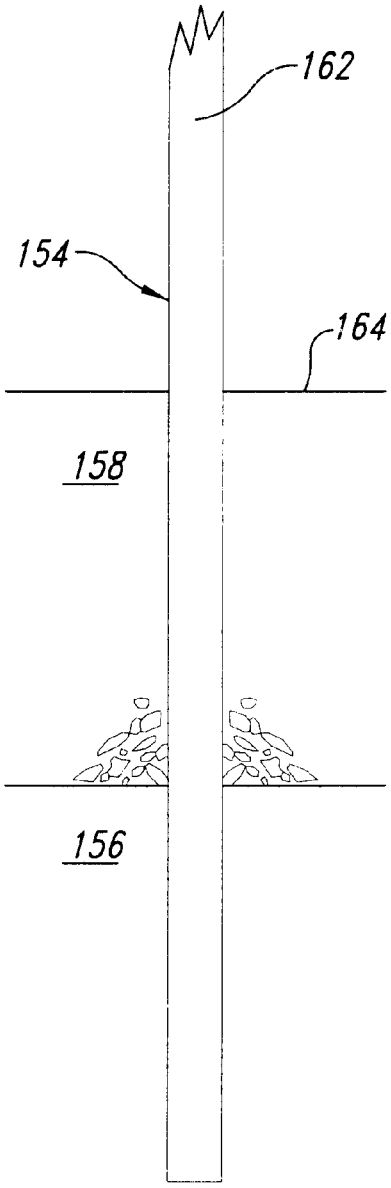
FIGS. 6A–6D are side views of a system and method of using of the embodiment of FIG. 2 for removing a piling and filling the resultant void.
Figure 6B:
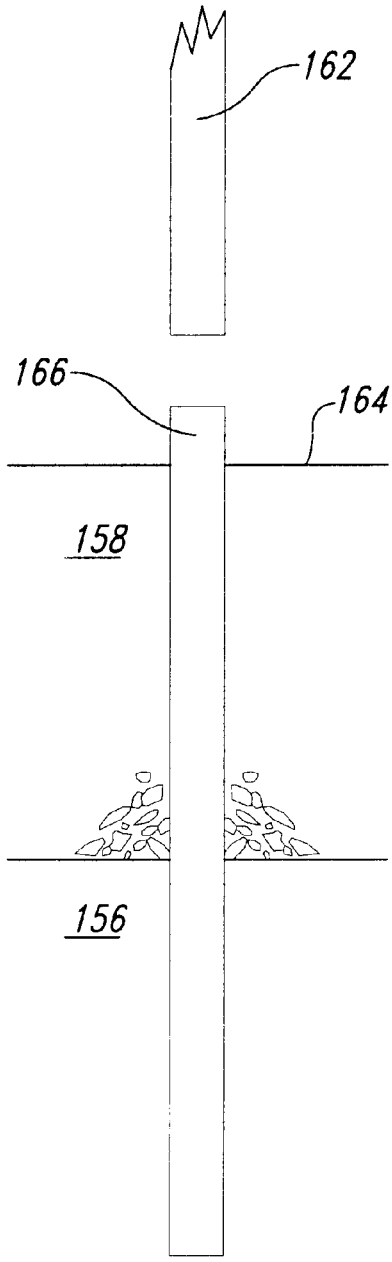

Once the estimated or actual length of the piling 154 is determined, the piling top 166 is cut to project a few feet above the water surface 164, as shown in FIG. 6B. This is to enable attachment of a choker chain or similar device to the piling 154, as described in more detail hereinbelow. Allowance is also made for fluctuations in the water surface 164 due to wind, wave action, and tides. However, the piling top 166 should not extend much higher than a few feet above the water surface 154 to avoid having to construct the casing longer than necessary and to avoid having to raise the water level inside the casing any higher than necessary. As described more fully below, the water level in the casing needs to be higher than the piling top 166 in order to force the air bubbles and entrained soil and debris to enter the trap. Of course, in embodiments where the rising soil and removed material are suctioned off, the height of the piling may vary from that described above.

Figure 6C:
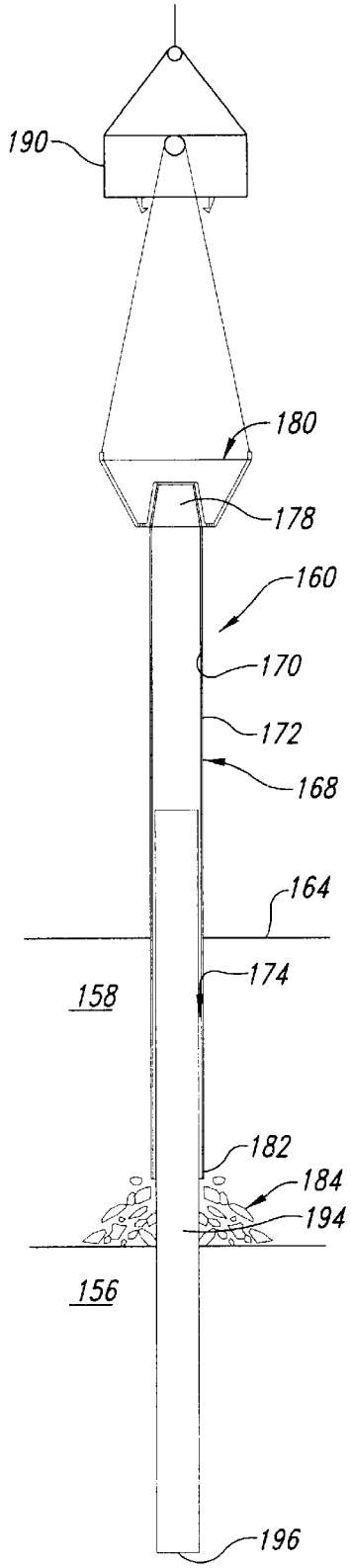
Figure 6D:
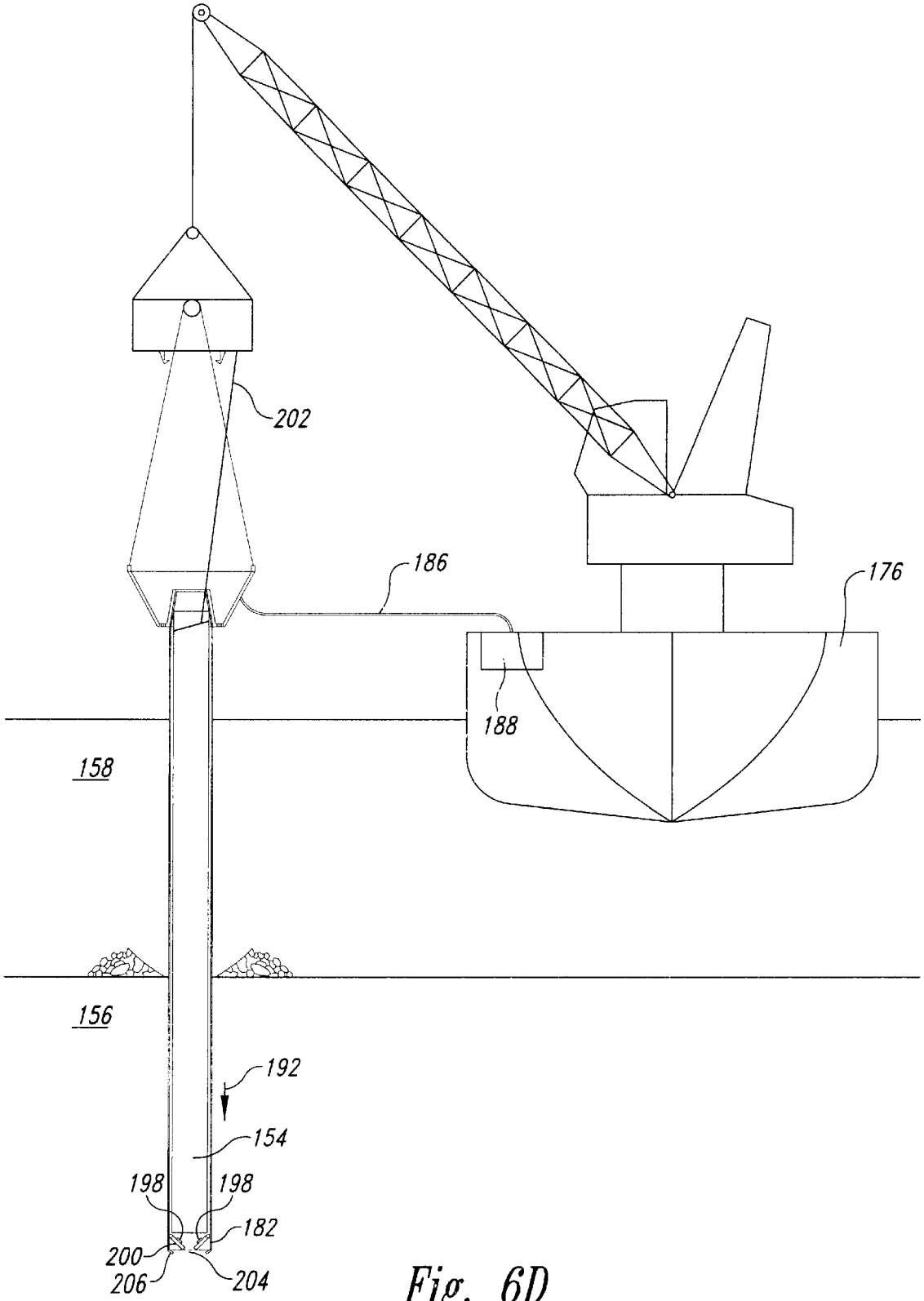

As shown in FIG. 6C, the casing 168 is then assembled, preferably in the field, to the diameter and estimated length of the piling 154. As previously described, the inside diameter $d_1$, as shown in FIG. 2, is 8 to 16 inches larger than the diameter of the piling to leave a circumscribing space of 4 to 8 inches, and ideally a space of 6 inches, between the piling 154 and the inside surface 170 of the casing wall 172. This forms a chamber 174 that directs the excavated soil and removed debris rising upward with the air bubbles from the pressurized air. (The fluid nozzles and closure doors are not shown in this view of the casing.) It is noted that the deeper the water, the greater will be the pressure to force the air bubbles to rise upward within the chamber 174.

The assembled casing 168 is then attached to a lifting device, such as the crane 104, which may be land based or supported by a vessel 176 on the water 158. Weight and lifting capacity permitting, the casing 168 can be assembled to include the funnel-shaped top 178 and the trap 180, which are lowered as a unit. In this mode, the choker chain may be first attached to the piling 154 and left on the exposed top to facilitate its retrieval and use after the assembled device 160 is lowered over the piling 154.

As the casing bottom 182 is slidably received over the piling 154, it will contact the soil 156 or the layer of debris 184 thereon. With the casing 168 at rest, the air hoses 186 are connected to a source of pressurized air 188. If used, the suction hoses (not shown) are also connected to a vacuum source. The vibratory hammer 190 is then used in conjunction with the crane 104 to drive the casing 168 into the soil 156. Pressurized air 192 is directed to the soil 156 at this time to loosen and excavate the soil 156 surrounding the piling 154. In addition, pressurized air 192 can be directed onto the piling 154 in order to clear material 194 thereon. However, caution should be used because decayed pilings can be blown apart by high-pressure air. Movable nozzles can be used in conjunction with the casing 168 to enable dynamic orientation of the nozzles from a remote location as the casing 168 is driven into the soil 156.

As the casing bottom 182 passes the bottom extremity 196 of the piling 154, which can be detected by a remote sensor (not shown) on the casing 168, which was described above, driving of the casing 168 into the soil 156 is stopped. Optional water jets 198 mounted on doors 200 at the casing bottom 182 can be used to completely remove the soil 156 underlying the piling 154. To prevent the piling 154 from settling further into the soil 156, the choker chain 202 previously attached to the piling top 166 is connected to the crane 104 and an upward force is exerted on the piling 154.

The high-pressure air 192, and water if used, will remove the sludge, debris, and contaminated material, forcing it to rise up the chamber 174, which is formed between the casing 168 and the piling 154, and it is removed at the piling top 166. Because certain contaminants, such as creosote, have a tendency to rise with the silt and excavated soil 156, the contamination will remain contained within the casing 168 until it is removed through the trap 180 or is suctioned off.

After the bottom extremity 196 of the piling is cleaned and the underlying soil 156 excavated, the doors 200 are shut to enclose the piling 154 in the casing 168. The piling 154 and the device 160 are then lifted out of the water. To prevent unnecessary lifting of the water and to reduce the weight to be lifted by the crane 104, drains may be provided in the casing 168 or in the doors 200 to let some or all of the water out.

Prior to removing the device 160, uncontaminated sand or other fill material may be injected into the void 204 that remains in the soil 156 after removal of the piling 154. The void 204 can be filled with sand that is pumped through the air hoses 186 and the nozzles 206 located at the casing bottom 182.

Figure 7A:
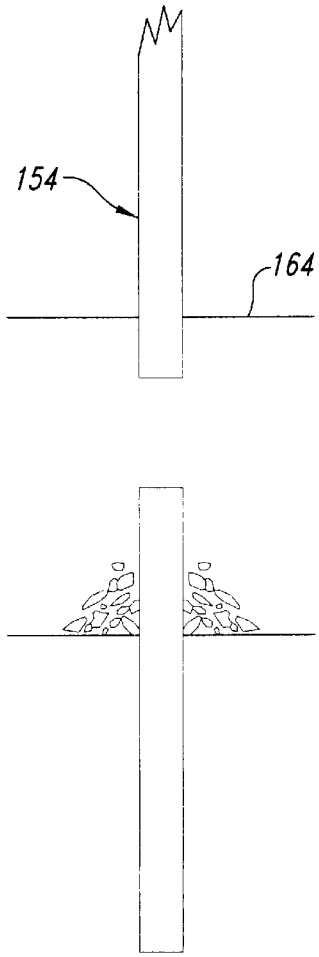
FIGS. 7A–7C are sides views of an alternative method using the embodiment of FIG. 4.
Figure 7B:
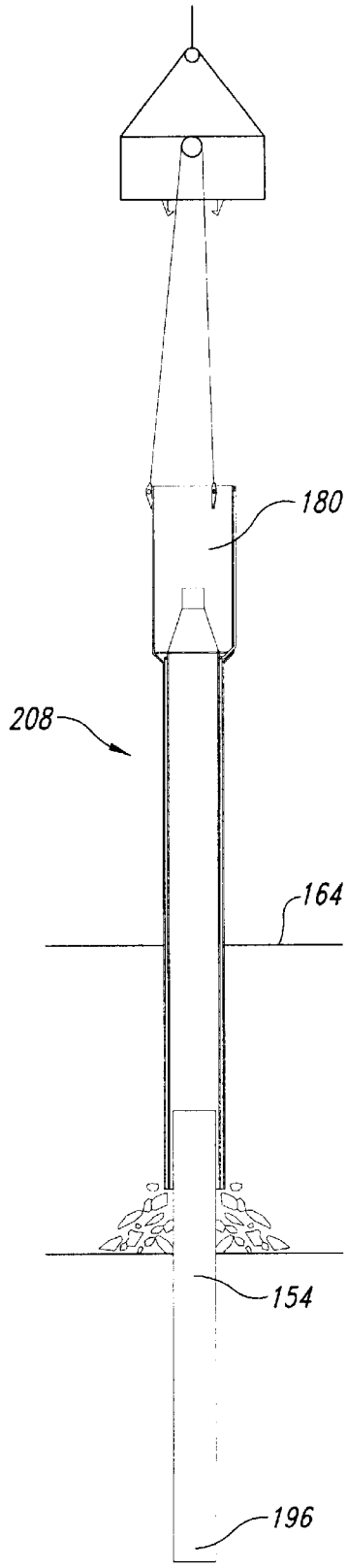
Figure 7C:
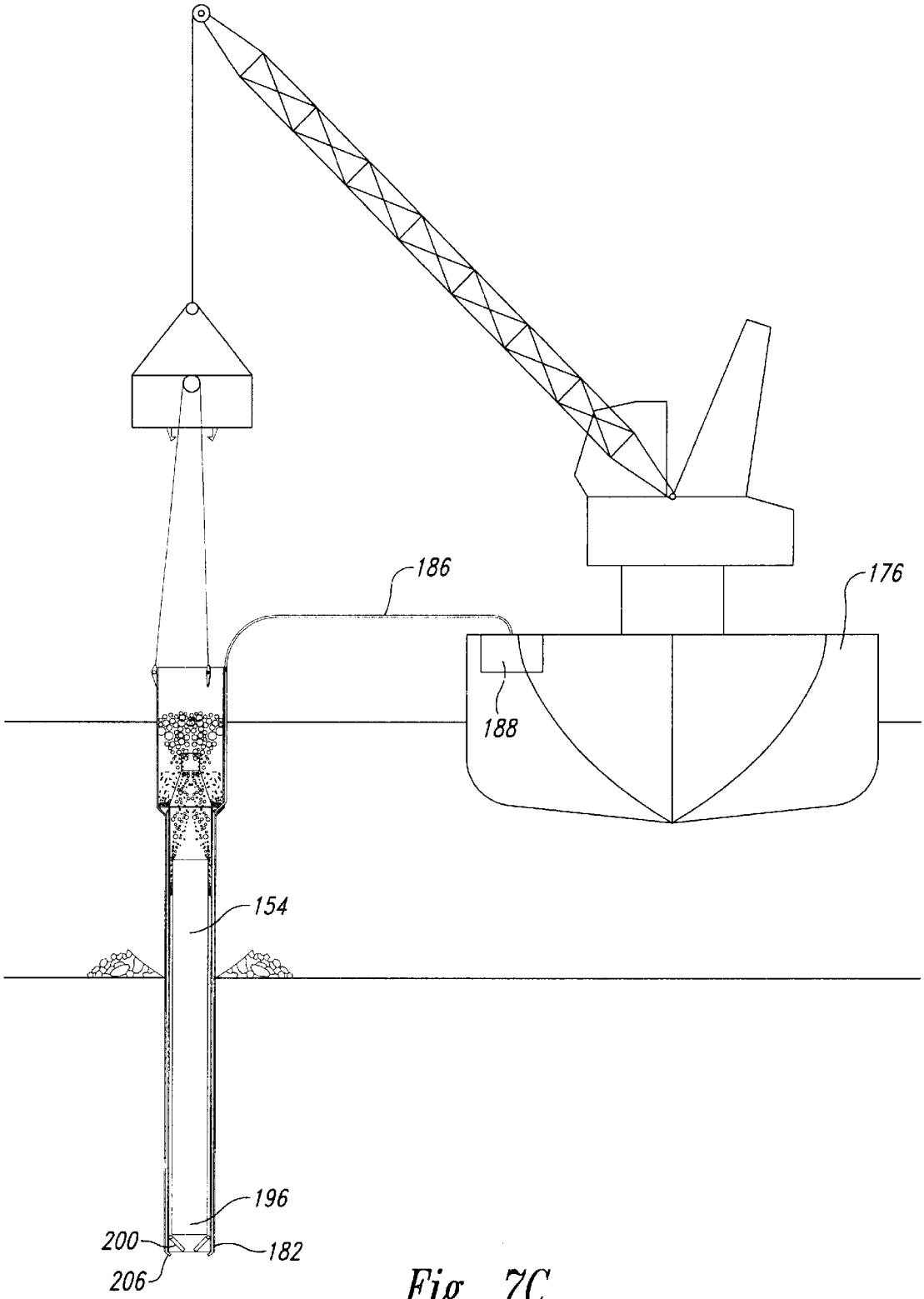

FIGS. 7A–7C show an alternative method wherein the piling 154 is cut below the water surface 164 as shown in FIG. 7A. In this event, the assembled device 208 is constructed so that the top of the trap 180 is above the water surface 164. Instead of attaching a choker cable to the piling, the casing 168 is driven below the bottom extremity 196 of the piling 154, and the doors 200 close off the casing bottom 182 to encase the piling 154 therein as shown in FIG. 7C.

Figure 8A:
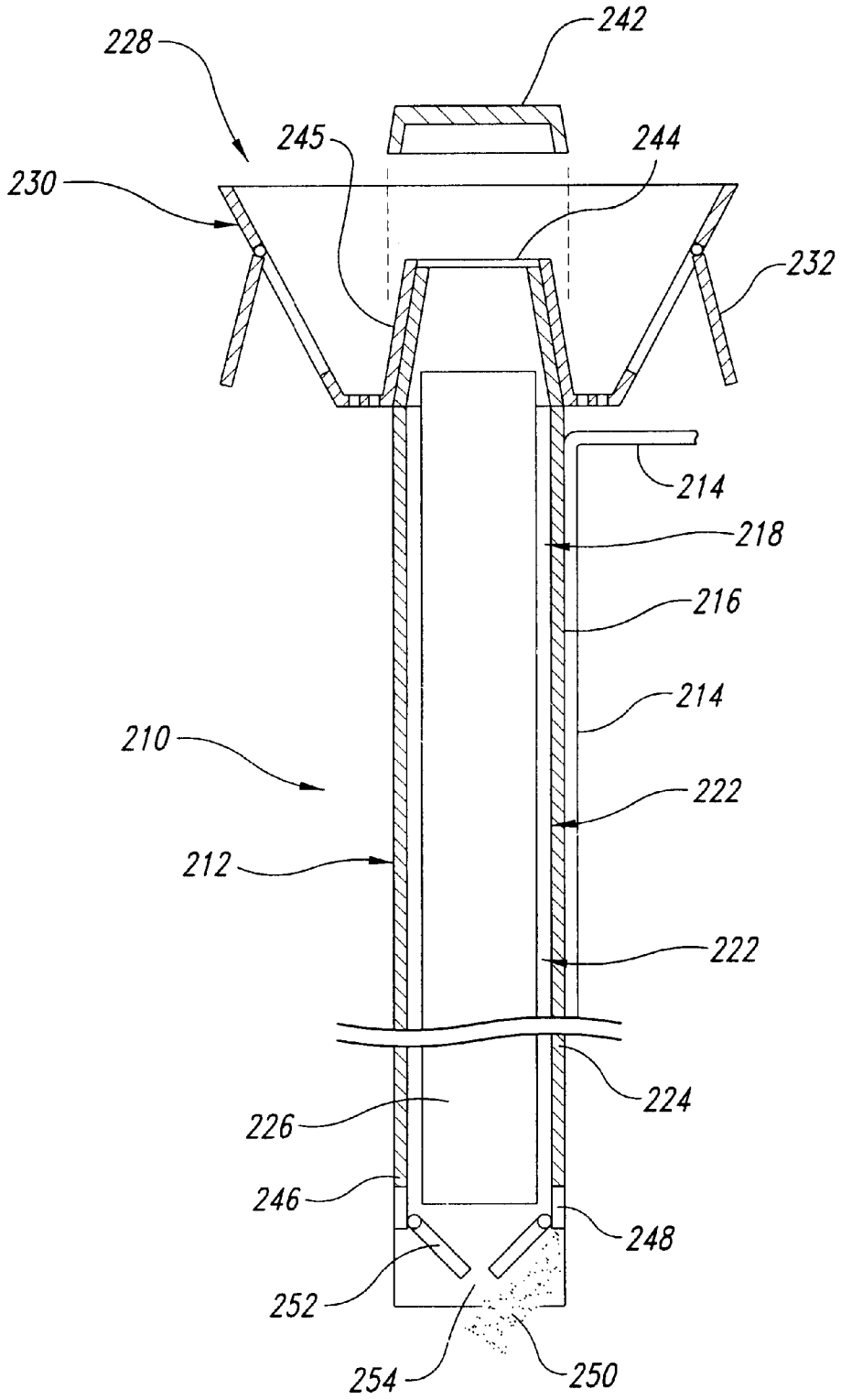
FIGS. 8A–8B are isometric views of yet another embodiment of a device for removing pilings formed in accordance with the present invention.

Another embodiment of the invention is shown in FIG. 8A, wherein a device 210 is shown having a casing 212 with external combination air and sand lines 214 formed on an exterior surface 216 at the top half 218 of the casing 12 and then passing through the casing wall 220 to be mounted on the interior 222 of the casing 212 on the bottom half 224 of the casing 212. This accommodates the piling taper, i.e., the reducing diameter of the piling from the top to the bottom of the piling 226.

Figure 8B:
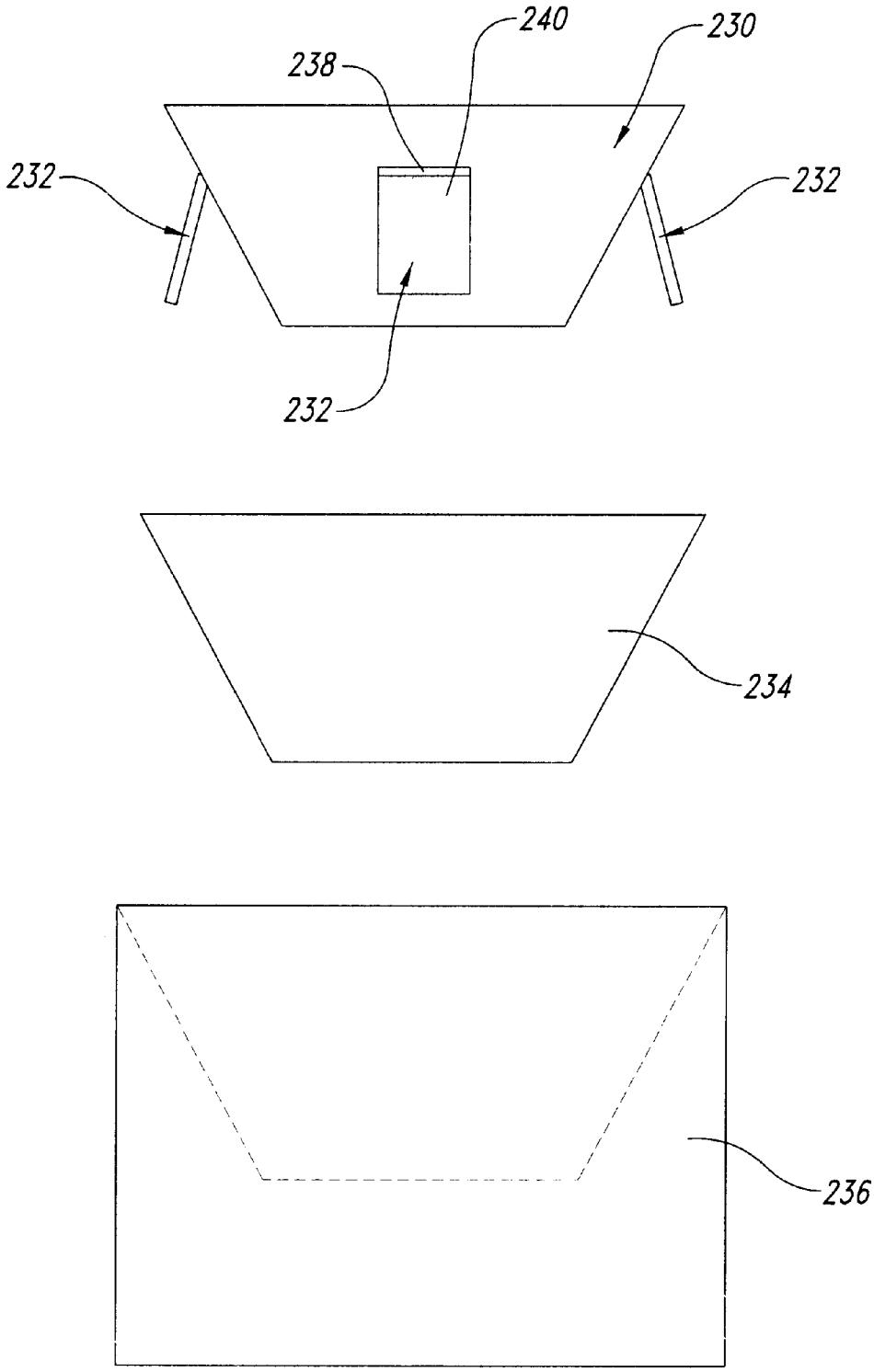

Also shown in FIG. 8A is a modified trap 228 having a filter basket 230 with at least one door 232, and at least three doors formed thereon in a preferred embodiment, that can be opened for cleaning the filter basket 230. More particularly, as shown in FIG. 8B, the filter basket 230 can be removed and placed inside a housing 234 that is received within a shipping container 236. The doors 232 can be opened to enable cleaning of the filter basket 230 and washing of debris therein into the container 236, where it can either be treated at that time or shipped to an outside treatment facility to decontaminate the material. In one embodiment, the doors 232 are hingedly attached to the filter basket 230 by hinges 238 at the top of each door 240. The doors 232 swing outward away from the exterior of the filter basket 230.

Referring back to FIG. 8, a locking cap 242 having a rubber gasket is attached to the top 244 of the funnel-shaped top 245, thus sealing the inside of the casing 212. This will help in a difficult extraction by enabling use of air pressure for extra lift as pressurized air evacuates the water from inside the casing 212. This can also aid in decontamination by sealing the casing 212 so that the churning action of the pressurized air is given extra power.

As shown at the bottom 246 of the casing 212, optional sand portals 248 are provided that direct decontaminated sand into the void 254 created by the removed piling 226. As shown in this embodiment, the sand 250 is directed below the doors 252 at the casing bottom 246. This permits the sand 250 to be injected into the void 254 after the piling 226 is sealed inside the casing 212 by the doors 252.

Although representative embodiments of the invention have been illustrated and described herein, it is to be understood that various changes may be made therein as will be obvious to those of ordinary skill in the art without departing from the scope of the invention. Hence, the invention is to be limited only by the scope of the appended claims and the equivalents thereof.

What is claimed is:

1. A device for removing an object from soil, comprising:

a casing sized to be slidably received over and completely surround the object and rest on the soil; and a soil excavating apparatus associated with the casing, comprising at least one nozzle for providing pressurized air and water towards at least the soil surrounding the object to loosen the soil, the casing configured to contain the water so that air rising in the water will lift the soil from around the object and maintain the soil within an interior of the casing, and a device for capturing and removing the loosened soil from the water in the interior of the casing.

2. A device for removing a post from soil, comprising:

a casing sized to be slidably received over and surround the post and rest on the soil;

a plurality of nozzles associated with the casing and configured to direct a stream of pressurized water towards the soil and the post to remove material from the post and to loosen the soil and the pressurized air and water contained within the casing to lift soil and the removed material from the post within an interior of the casing;

means for removing the material and the loosened soil from the water within the interior of the casing; and means for driving the casing into the soil as loosened soil is lifted and removed.

3. The device of claim 2 wherein the pressurized fluid comprises a mixture of compressed air and water, and the casing is configured to maintain the air and water within the interior of the casing to direct the air and water and loosened soil and removed material contained therein to rise towards a top of the casing.

4. The device of claim 3 wherein the removing means comprise a device for suctioning the loosened soil and removed material from a surface of the water in the interior of the casing.

5. The device of claim 2 wherein the removing means comprise a filter mounted in the interior of the casing and configured to capture the removed material and the soil in the interior of the casing.

6. The device of claim 2, further comprising a closure mechanism at one end of the casing to enclose the post within the casing as the post is removed from the soil.

7. The device of claim 2, further comprising ballast attached to the casing to provide additional weight to the casing, the ballast comprising fill material for replacing the removed soil and the post.

8. A tool for removing a piling from soil under water, comprising:

a casing having an interior and sized and shaped to be slidably received over the piling an rest on the soil;

a plurality of air nozzles mounted near a first end of the casing and oriented to direct pressurized air towards at least the soil to loosen the soil around the piling and force the loosened soil to rise to the water surface within the interior of the casing, the casing configured to move into the soil as the loosened soil rises to the surface of the water; and a device for removing the soil from the water in the interior of the casing.

9. The tool of claim 8 wherein the device for removing the soil comprises a pump assembly configured to suction the loosened soil from water surface in the interior of the casing.

10. The tool of claim 9 wherein the device for removing the Soil comprises a filter mounted in the interior of the casing and configured to capture the soil forced to rise to the water surface by the pressurized air.

11. A tool for removing a piling from soil underwater, the tool comprising:

a casing having an interior and sized and shaped to be slidably received over the piling;

a plurality of air nozzles mounted on the casing and oriented to direct pressurized air towards the piling and the soil to loosen the soil around the piling and remove material from the piling and force the soil and removed material to rise to the water surface and remain in the interior of the casing, the casing configured to be driven into the soil as loosened soil rises with the air in the water; and a device for removing the soil and the material from the water in the interior of the casing.

12. The tool of claim 11 wherein the device for removing the soil and material comprises a filter mounted on the interior of the casing to capture the soil and the material forced to rise to the water surface by the pressurized air.

13. The tool of claim 11 wherein the device for removing the soil and material comprises a pump coupled to the casing to suction the soil and the material from the water in the interior of the casing.

14. The tool of claim 11, further comprising a closure device mounted at a first end of the casing and configured to enclose the piling within the casing as the piling is removed from the soil.

15. The tool of claim 11, further comprising ballast attached to the casing to provide additional weight to the casing and to provide fill material to replace the removed soil and the piling.

16. A system for removing a post from soil, the system comprising:

a casing sized to be slidably received over the post and rest on the soil;

a plurality of nozzles associated with the casing and configured to direct a stream of pressurized fluid comprising air and water towards the soil and the post to remove material from the post and to loosen and lift soil and the removed material from the post within an interior of the casing;

means for removing the removed material and the loosened soil from within the interior of the casing;

a device for forcing the casing into the soil as loosened soil is lifted by the air rising in the water in the interior of the casing; and a device for pulling the post from the soil.

17. A system for removing a piling from soil under water, the system comprising:

a casing sized to be slidably received over the piling and rest on the soil;

a plurality of air nozzles mounted on the casing and oriented to direct pressurized air towards the piling and the soil to loosen the soil around the piling and remove material from the piling and force the soil and removed material to rise to the water surface in an interior of the casing;

a device for removing the loosened soil and the material from the water in the interior of the casing;

a device for forcing the casing down into the soil as loosened sod rises to the water surface; and a device for pulling the piling from the soil.

18. A method for removing a post from soil, the method comprising:

placing a casing around the post to rest on the soil;

directing pressurized air and water into the soil around the piling to loosen the soil;

driving the casing into the soil as the soil is loosened;

excavating the soil loosened from around the piling by using the pressurized air to force the soil to rise in the water inside the casing;

removing the from the water rising inside the casing as it is forced upward inside the casing by the rising air; and removing the post.

19. A method for removing a piling from soil under water, the method comprising:

placing a casing around the piling to rest on the soil;

directing at least pressurized air through nozzles on the casing to the soil to loosen the soil and force the soil to rise upward in the water inside the interior of the casing;

driving the casing into the soil as the soil is loosened;

removing the soil from the water inside the casing as the soil is forced upward by air rising inside the casing; and removing the post.

20. The method of claim 19, further comprising enclosing the bottom of the casing as the piling is removed.

21. The method of claim 20, further comprising depositing clean fill material to replace the soil excavated by the pressurized air and to fill the void left by the removed piling.

22. A device for removing a post from soil, comprising:

a casing sized to be slidably received over the post;

a plurality of nozzles associated with the casing and configured to direct a stream of pressurized fluid comprising air towards the soil and the post to remove material from the post and to loosen and lift soil and the removed material from the post within an interior of the casing;

means for removing the material and the loosened soil from within the interior of the casing; and a closure mechanism at one end of the casing to enclose the post within the casing as the post is removed from the soil.

23. A device for removing a post from soil, comprising:

a casing sized to be slidably received over the post;

a plurality of nozzles associated with the casing and configured to direct a stream of pressurized fluid comprising air towards the soil and the post to remove material from the post and to loosen and lift soil and the removed material from the post within an interior of the casing;

means for removing the material and the loosened soil from within the interior of the casing; and ballast attached to the casing to provide additional weight to the casing, the ballast comprising fill material for replacing the removed soil and the post.

24. A tool for removing a piling from soil underwater, the tool comprising:

a casing having an interior sized and shaped to be slidably received over the piling;

a plurality of air nozzles mounted on the easing and oriented to direct pressurized air towards the piling and the soil to loosen the soil around the piling and remove material from the piling and force the soil and removed material to rise to the water surface; and a device for removing the soil and the material from the water in the interior of the casing, the device comprising a filter mounted on the interior of the casing to capture the soil and the material forced to rise to the water surface by the pressurized air.

25. A tool for removing a piling from soil underwater, the tool comprising:

a casing having an interior sized and shaped to be slidably received over the piling;

a plurality of air nozzles mounted on the casing and oriented to direct pressurized air towards the piling and the soil to loosen the soil around the piling and remove material from the piling and force the soil and removed material to rise to the water surface;

a device for removing the soil and the material from the water in the interior of the casing; and ballast attached to the casing to provide additional weight to the casing and to provide fill material to replace the removed soil from the piling.

26. A method for removing a piling from soil under water, the method comprising:

placing a casing around the piling;

directing at least pressurized air through nozzles on the casing to the soil to loosen the soil and force the soil to rise upward inside the interior of the casing;

driving the casing into the soil;

removing the soil from inside the casing as the soil is forced upward inside the casing; and removing the post, comprising enclosing the bottom of the casing as the piling is removed.

27. A method for removing a piling from soil under water, the method comprising:

placing a casing around the piling;

directing at least pressurized air through nozzles on the casing to the soil to loosen the soil and force the soil to rise upward inside the interior of the casing;

driving the casing into the soil;

removing the soil from inside the casing as the soil is forced upward inside the casing;

removing the post, comprising enclosing the bottom of the casing as the piling is removed; and depositing clean fill material to replace the soil excavated by the pressurized air and to fill a void left by the removed piling.

* * * * *

UNITED STATES PATENT AND TRADEMARK OFFICE

CERTIFICATE OF CORRECTION

PATENT NO. : 6,672,408 B2
DATED : January 6, 2004
INVENTOR(S) : Anthony F. Frantz It is certified that error appears in the above-identified patent and that said Letters Patent is hereby corrected as shown below:

Column 9,
Line 41, “pressurized water” should read as -- pressurized air and water --.

Column 10,
Line 8, “piling an rest” should read as -- piling and rest --.

Column 11,
Line 19, “loosened sod” should read as -- loosened soil --.

Column 12,
Line 14, “easing” should read as -- casing --.

Signed and Sealed this

Fourteenth Day of September, 2004

JON W. DUDAS
*Director of the United States Patent and Trademark Office*